US010595127B2

(12) United States Patent
Namm

(10) Patent No.: US 10,595,127 B2
(45) Date of Patent: Mar. 17, 2020

(54) METHOD AND APPARATUS FOR MANAGING AUDIO SIGNALS IN A COMMUNICATION SYSTEM

(71) Applicant: MOTOROLA SOLUTIONS, INC, Chicago, IL (US)

(72) Inventor: Joseph C Namm, Plantation, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 324 days.

(21) Appl. No.: 15/359,341

(22) Filed: Nov. 22, 2016

(65) Prior Publication Data

US 2018/0146289 A1 May 24, 2018

(51) Int. Cl.

| | |
|---|---|
| ***H04R 3/12*** | (2006.01) |
| ***H04H 60/58*** | (2008.01) |
| ***H04H 20/62*** | (2008.01) |
| ***H04H 60/37*** | (2008.01) |
| ***H04H 60/65*** | (2008.01) |
| ***H04H 20/59*** | (2008.01) |
| ***H04H 60/13*** | (2008.01) |

(52) U.S. Cl.

CPC ..... *H04R 3/12* (2013.01); *H04H 20/59* (2013.01); *H04H 20/62* (2013.01); *H04H 60/13* (2013.01); *H04H 60/37* (2013.01); *H04H 60/58* (2013.01); *H04H 60/65* (2013.01); *H04R 2499/13* (2013.01); *H04S 2400/11* (2013.01)

(58) Field of Classification Search

CPC ..... H04R 3/12; H04R 2499/13; H04S 7/40; H04S 2400/11; H04H 20/59; H04H 20/62; H04H 20/71; H04H 60/13; H04H 60/37; H04H 60/58; H04H 60/65

See application file for complete search history.

(56) References Cited

U.S. PATENT DOCUMENTS

| | | | | | |
|---|---|---|---|---|---|
| 4,627,107 | A | * | 12/1986 | Hohlfeld | H04B 7/2606 455/11.1 |
| 4,955,071 | A | * | 9/1990 | Wong | H04B 1/3877 361/726 |
| 5,073,972 | A | * | 12/1991 | Tendler | H04B 1/3877 340/7.5 |
| 5,390,341 | A | * | 2/1995 | Ziniel | H04B 1/3822 455/194.1 |
| 6,404,442 | B1 | | 6/2002 | Hilpert et al. | |

(Continued)

FOREIGN PATENT DOCUMENTS

GB 2385762 8/2003

*Primary Examiner* — Davetta W Goins
*Assistant Examiner* — Daniel R Sellers
(74) *Attorney, Agent, or Firm* — Barbara R. Doutre

(57) ABSTRACT

A method and system of managing audio signals within a communication system is provided. An audio signal is received on two or more independent audio paths within an operating environment, such as a vehicular operating environment (106). A controller identifies an audio source ID associated with the audio signal. The audio source ID may be a talkgroup ID, an individual ID, or a channel ID associated with the audio signal. The received audio signal from the independent audio paths is mixed and played out at a spatially separated unique location within the vehicle from other audio signals based on the sound source ID, each sound source ID having a unique location within the vehicle.

12 Claims, 3 Drawing Sheets

(56) References Cited

U.S. PATENT DOCUMENTS

| | | | | |
|---|---|---|---|---|
| 7,508,840 | B2 * | 3/2009 | Delaney | H04W 92/02 370/466 |
| 8,699,963 | B2 | 4/2014 | Chen et al. | |
| 2003/0081796 | A1 * | 5/2003 | Bray | H04B 1/20 381/86 |
| 2006/0147028 | A1 * | 7/2006 | Hancock | H04H 20/59 379/387.01 |
| 2008/0299899 | A1 * | 12/2008 | Wolfe | H04B 1/3805 455/15 |
| 2013/0051560 | A1 | 2/2013 | Ray et al. | |
| 2013/0148751 | A1 * | 6/2013 | Kumhyr | H04W 4/08 375/259 |
| 2014/0368650 | A1 | 12/2014 | Ray et al. | |
| 2016/0269877 | A1 * | 9/2016 | Tang | H04W 4/10 |

* cited by examiner

METHOD AND APPARATUS FOR MANAGING AUDIO SIGNALS IN A COMMUNICATION SYSTEM

FIELD OF THE INVENTION

The present invention relates generally to a communication system and more particularly to managing the reception of a plurality of audio signals from different sources.

BACKGROUND

Communication systems, particularly those used in public safety environments such as fire rescue, law enforcement, and mission-critical environments, often utilize a portable and/or mobile vehicular radio that communicate using multiple audio sources. Depending on the type of communication system, audio sources may originate from different talkgroups, different individuals, and communications on different channels to name a few. Hence, a public safety user working within such a system often listens to multiple audio sources within each of these groups. When the radio unmutes, the user must decide whether to ignore or divert attention to the latest transmission. Either way, the user may momentarily be distracted from the current task at hand which might include driving a vehicle, operating a dispatch center, or other task where maintaining focus is of particular importance. It would be beneficial to manage incoming audio signals to minimize diverting the user's attention away from current tasks.

Accordingly, there is a need for managing incoming audio transmission signals in a communication system.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
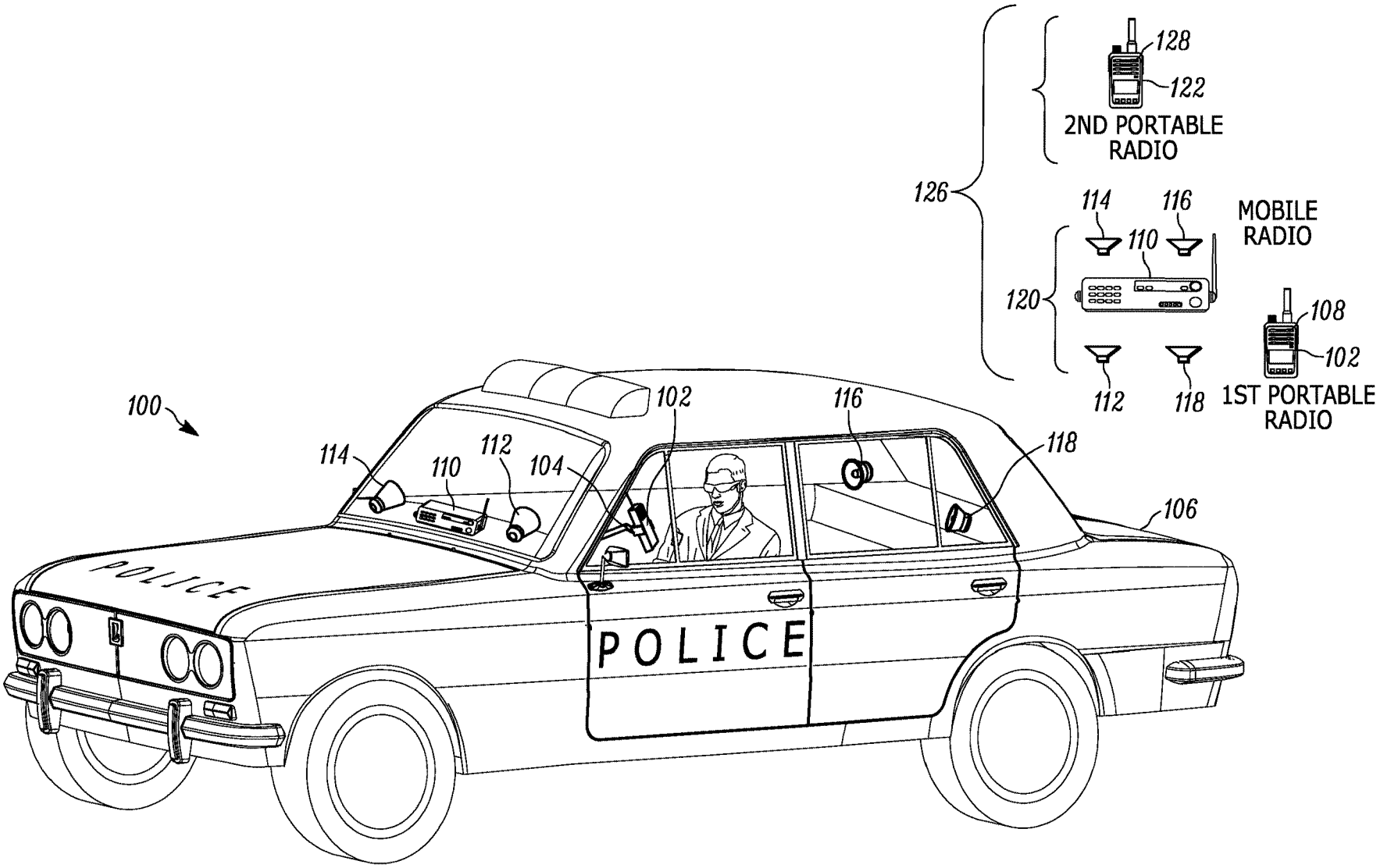
FIG. 1 communication system formed and operating in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is provided herein a communication system and method of managing audio signals within a communication environment. Multiple audio sources are able to play out audio signals at speaker locations and/or perceived locations within the communication environment so as not to divert the user's attention away from tasks at hand. In an embodiment, the communication system provides a mobile two-way radio having a plurality of speakers located within a vehicular environment and a portable two-way radio having a speaker located within the vehicle. A received audio signal comes into the system on at least two independent audio paths, the portable and the mobile. The system further comprises a controller of the mobile radio or the portable radio for identifying a sound source ID (also referred to as audio source ID) for the received audio signal. The sound source ID comprises at least one of: a talkgroup ID, An individual ID, and a channel ID. The received audio signal from the two paths is mixed to play out at a spatially separated unique location within the vehicle from other audio signals based on the sound source ID, each sound source ID having a unique location within the vehicle. Each sound source ID is associated with a sound source location within a grid pattern. The controller identifies each sound source ID and maps, for predetermined speaker location, if applicable, each identified sound source ID to a location in the grid pattern associated with the pre-assigned speaker. The controller further identifies each sound source ID and maps, for non-predetermined speaker locations, each identified sound source ID to a 'perceived location' in the grid pattern, the perceived location being between two or more of the plurality of speakers. The received audio signal is mixed and adjusted so as to be perceived to play out at a unique location within the grid. Hence, some incoming received audio is assigned to play out at predetermined speakers and some audio is dynamically adjusted and played out at perceived locations between the plurality of speakers within the grid creating overall spatially allocated separated received audio signals which are easily differentiated by a user or users within a vehicle.

Additionally, predetermined sound source IDs may further have predetermined ranking with respect to each other which establishes volume setting, muting, in addition to location. This further enhances the ability to differentiate audio signals within the grid of the embodiments.

FIG. 1 communication system 100 formed and operating in accordance with some embodiments. Communication system 100 comprises a battery operated, portable two-way radio 102 which may be clipped or otherwise mounted to the user or inserted within a charging cradle 104 located within the vehicle 106. The public safety vehicle 106 further comprises a vehicular, two-way mobile radio 110. The communication system 100 further comprises a plurality of speakers situated throughout the vehicle, for example a plurality of speakers such as those shown distributed at front and back at left and right corner locations 112, 114, 116, 118 of the vehicle or some other predetermined positioning within the vehicle. The portable radio 102 having speaker 108 along with mobile radio 110 having a plurality of speakers associated and located within a predetermined area, such as situated throughout the vehicle 106, form an operating environment 120. The portable radio 102 and mobile radio provide first and second audio paths which receive and incoming audio signal. Other operating environments, such as a dispatch center can form an operating environment with many independent audio paths and a plurality of incoming audio signals and the embodiments described herein to the vehicular environment can be applied there as well.

An audio signal is received on two or more independent audio paths within the operating environment 120. In the embodiment, the audio signal is received at the portable radio 102 and at the mobile radio 110. In accordance with the embodiment, a controller, of either the portable radio 102 or mobile radio 110, identifies an audio source ID associated with the audio signal. In accordance with the embodiments, the audio source ID comprises at least one of a talkgroup ID, an individual ID, and a channel ID associated with the audio signal. In accordance with the embodiment, the received audio signal from the two or more independent audio paths (for example associated with portable radio 102 and mobile radio 110) are mixed so that the audio signal is spatially resolved to play out at a single unique perceived location based on the audio source ID. For example, the audio signal is mixed by the two or more speakers based on audio source ID.

Additionally, the operating environment 120 may also handle receiving an additional different audio signal. For example, another portable radio 122 having a speaker 128 used by a passenger, such as another police office or fire rescue personnel may join operating environment 120 forming a larger communication environment 126 within vehicle 106. In this case, the mobile radio 110 having a controller would be able to identify the portable radio 122 via scan known scan methods and identify the portable's the audio source ID. Having the additional different audio signal on an additional audio path results in the different additional audio signal being spatially resolved to play out at another unique perceived location based on its own audio source ID.

Additionally, the embodiments contemplate that the two or more independent audio paths may alternatively comprise an audio path associated with a portable radio having a speaker, and one or more audio paths associated with a dispatch center having a plurality of speakers.

In some embodiments, each sound source ID may further be assigned to a predetermined ranking with respect to each other to establish speaker playout location, volume setting and muting. For example, a higher priority sound source ID may be assigned to a Chief/Commander and played out at a higher volume at a speaker location which is located closer to the user, while a lesser priority sound source ID, associated with a different user, is either lowered in audio, muted entirely, or mixed to its own unique perceived location.

Figure 2:
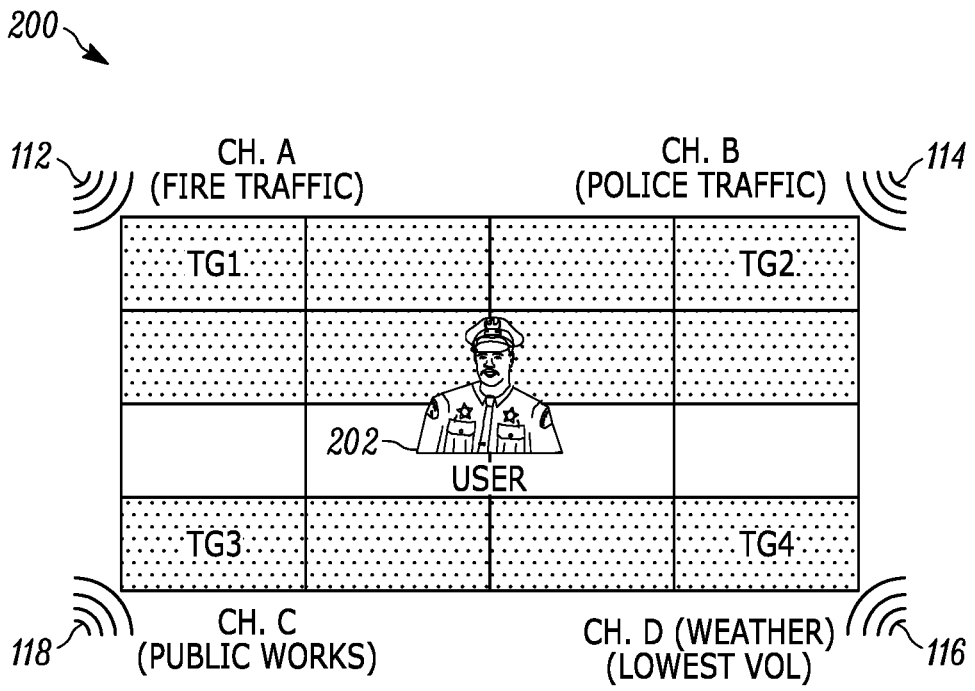
FIG. 2 is an example of a talkgroup ID array in accordance with some of the embodiments.
Figure 3:
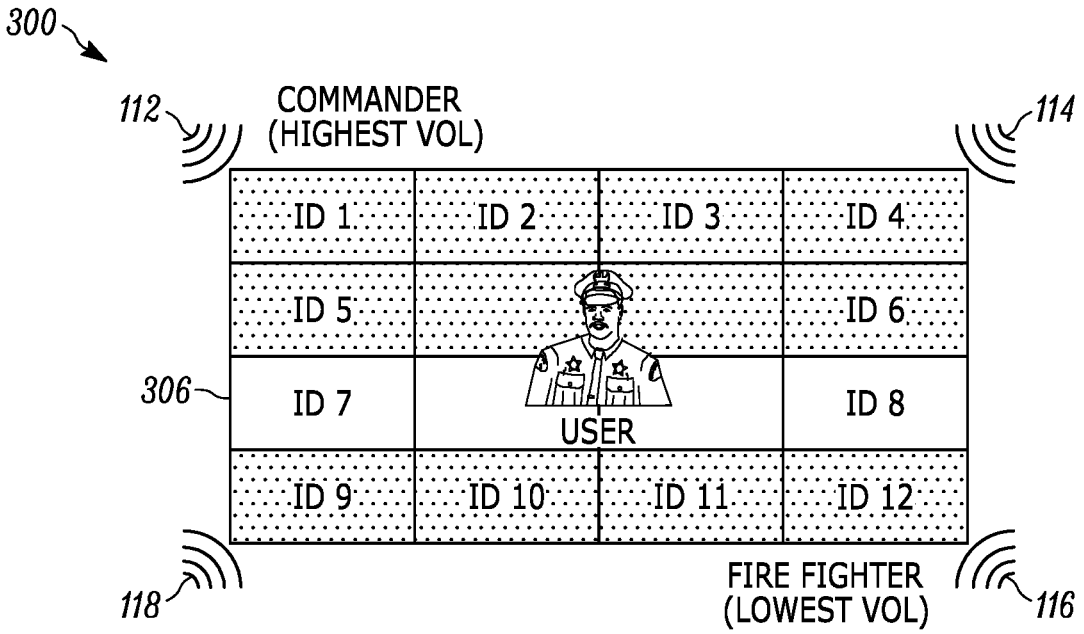
FIG. 3 is an example of an individual ID array in accordance with some of the embodiments.

Rather than having the audio coming from all four speakers and even the radio speaker, the embodiments provide for selectively controlling the audio based on the audio source ID. The audio is mixed and played out at one unique location, and further depending on the audio source ID may have predetermined characteristics for location and loudness based on priority. FIG. 2 and FIG. 3 to be described next provide examples of single unique audio play-out locations for different talkgroup IDs and individual IDs is accordance with some embodiments.

FIG. 2 is an example a talkgroup ID (TG ID) grid array 200 formed of real and perceived unique audio origination locations in accordance with some embodiments. Although shown in the middle for purposes of illustrating the grid, in this embodiment a user 202 may be a driver of the vehicle 106 of FIG. 1 and for the purpose of example the same four speakers front, back, left and right speakers 112, 114. 116, 118 are situated around the user. Each of the four speakers 112, 114. 116, 118 will have a predetermined TG ID assigned thereto with priority and ranking. For example, an audio traffic signal generated by audio source TG1 is predetermined to play out of first speaker 112 located closest to the user and played out with the loudest audio volume setting. An audio traffic signal generated by audio source TG4 is predetermined to play out with the lowest audio from the back right speaker 118, located furthest from the user and played out with the lowest audio volume setting.

The audio source of Talkgroup 1 (TG1) may be predetermined, for example, to play out on Channel A traffic, wherein Channel A traffic is a fire rescue traffic channel. Thus, the highest ranked talkgroup is preconfigured to play out at a predetermined speaker which is closest to the user, in this case speaker 112, and which is further played out at maximum volume.

Talkgroup 2 (TG2) can be assigned to Channel B which could be, for example, a second ranked priority channel such as a police traffic channel. The second ranked priority channel traffic may be assigned to play out at speaker 114 of the array which is still in close proximity at the front of the vehicle.

Talkgroup 3 (TG3) may be assigned to channel C which could be, for example, a public works traffic channel. This third ranked priority channel traffic may be assigned to play out at speaker 118 of the array which is behind the user, located as the back left speaker.

Talkgroup 4 (TG4) may be assigned to channel D traffic which could be, for example, a weather channel. Depending on the user, weather broadcast may be channel with the least importance, relative to the first 3 talkgroups, and may be played out at speaker 116 which is furthest away from the user and played with the least amount of volume.

Other audio source Talkgroup IDs that may not have been pre-configured to a particular speaker, but still be received into the system. These non-preconfigured received audio signals can be spatially allocated to originate from a perceived unique location between the speakers 112, 114. 116, 118. For example, an audio signal coming into the environment on two independent audio paths, such as the portable radio 102 and the mobile radio 110 from FIG. 1, having an unconfigured audio source TG ID associated therewith may be mixed and played out to be perceived to be being played out at a grid location 204 or 206 in between the two speakers 116, 118.

In accordance with some embodiments, the mixing of the audio signal from the at least two independent audio paths of, for example a mobile radio and a portable radio, may be achieved by taking each audio signal and adjusting the modulation in each speaker such that the combined sound emanating from each speaker results in each of the audio paths resolving to a unique location in space. The speakers used are selected based on the audio source ID, and even with no predetermined speaker assignment, may be selected from two or more of the plurality of speakers within the communication environment so as to dynamically generate a unique location, relative to other pre-assigned locations. In some embodiments depending on the mounting location, even the speaker of the portable communication device may be used as part of the speaker mixing collaboration. The TG ID grid array 200 and the Individual ID grid array 300 to be described next illustrate how an audio signal coming to two independent audio paths can be resolved to play out at a single unique location (or perceived location) to minimize ambiguity for a user working in a communications environment, such as a vehicle or dispatch center, with many incoming audio signals originating from different audio sources.

FIG. 3 is an example of a Individual ID audio source grid array 300 formed of real and perceived unique audio origination locations in accordance with some of the embodiments. In this example, a plurality of individuals are operating on a single channel and a plurality of individual IDs form Individual ID grid array 300 in accordance with some of the embodiments. Here again user 302 may be a driver of the vehicle 106 of FIG. 1 and for the purpose of example the same four speakers front, back, left and right speakers 112, 114, 116, 118 are situated around the user. Each of the four speakers will have a predetermined Individual ID associated therewith and to which the system gives priority ranking. For example, a received audio signal generated by Individual ID1 is predetermined to play out at first speaker 112, located closest to a driver within a vehicle, and played out with the loudest predetermined audio level setting. Remaining audio source individual IDs are distributed within a grid pattern so as to have a unique location at which to generate audio. Some audio source individual IDs are pre-assigned to locations, while others can be dynamically set as individual IDs enter an incident scene while communicating with the driver 302 of a vehicle.

An audio source identified with Individual ID 1 (ID1) can be, for example, assigned to a highest ranked individual ID, such as a Fire Rescue Incident Commander, and therefore the speaker 112 of the plurality of audio speakers which is closest to the user 302 (for example when the user 302 is seated as a driver in a car) is selected. Additionally, a predetermined maximum volume may further be set for automatically playing out audio originating from the Incident Commander at maximum volume. Thus, in accordance with the embodiments, the audio signal is positioned to a unique location and volume level set within the vehicle based on the individual ID's ranking.

An audio source identified Individual ID 4 (ID4) may be assigned to an individual working as a second in command. The speaker 114 of the plurality of audio speakers which is the second closest speaker to the driver-user 302 may be selected along with a second predetermined maximum volume setting for playing out audio originating from the second in command.

An audio source identified Individual ID 9 (ID9) may be assigned to an individual working as a firefighter 9. Speaker 118, of the plurality of audio speakers, situated behind the driver-user may be selected along with a different predetermined volume setting for playing out audio originating from firefighter 9.

An audio source identified Individual ID 12 (ID12) may be assigned to an individual working as a firefighter 12, and therefore the speaker 116 of the plurality of audio speakers which is the furthest speaker to the user may be selected along with a lowest predetermined volume setting for playing out audio originating from this firefighter, depending on the firefighter's role.

The above locations can be varied as new individual IDs enter generate audio signals into a user's vehicular environment. In accordance with the embodiments, the system advantageously allows incoming audio signals to be generated or perceive to be generated at single unique locations thereby minimizing distractions for the user-driver. Volume settings can also be varied depending on individual ID involved in an incident. For example there may systems where pre-configuration of volume is better suited to have louder volume generated from the back and of a vehicle and lower volume generated at the front of the vehicle.

Other audio source individual IDs for the remaining firefighters may have been pre-configured to a particular location within the array as shown, but even if not pre-configured, an audio signal originating from one of the audio source individual IDs: ID2, ID 3, ID 7, ID 8, ID 10, or ID 11 can be received and automatically spatially allocated. These non-preconfigured received audio signals can be spatially allocated to originate from a perceived unique location between the speakers 112, 114. 116, 118. For example, an audio signal coming into the environment on two independent audio paths, such as the portable radio 102 and the mobile radio 110 of FIG. 1, having an unconfigured audio source, such as individual ID 6 associated therewith (i.e. not assigned to a predetermined speaker) may be mixed and played out by speakers 114 and 116 but perceived to be being played out at a grid location 304 in between the two speakers 114, 116. As another example, an audio signal coming into the environment on two independent audio paths, such as the portable radio 102 and the mobile radio 110 of FIG. 1, having an unconfigured audio source individual ID 7 associated therewith may be mixed and played out by speakers 112 and 118 but perceived to be being played out at a grid location 306 in between the two speakers 112, 118. Thus, the driver-user is able to have perceived audio played out at unique locations within individual ID grid array 300 which minimizes ambiguity for the driver-user or others within the vehicle.

In accordance with some embodiments, the ID grid arrays 200 and 300 may be controlled via a controller, such as the mobile radio's controller, such that each sound source ID is associated to a sound source location within a grid pattern. Alternatively, since a communication system may not have predetermined speaker allocation for every incoming audio source ID, the controller can identify each sound source ID and map each identified sound source ID to a location in a grid pattern associated with one of the plurality of speakers. For example, upon receiving an audio signal from an audio source associated with Individual ID 11, the controller verifying that no pre-assignment having been made, may allocate that the audio signal coming in from two independent paths be mixed and played out at a perceived location located between speaker 116 and speaker 118.

Additionally, for some predetermined sound source IDs there can be predetermined rankings with respect to each other which establish volume setting, muting, in addition to location. For example, a higher priority sound source ID may be desirable to have played out at a higher volume at a speaker location which is located closer to a user, while a lesser priority sound source ID is either muted or played out at a speaker location which is located farther from the user.

Figure 4:
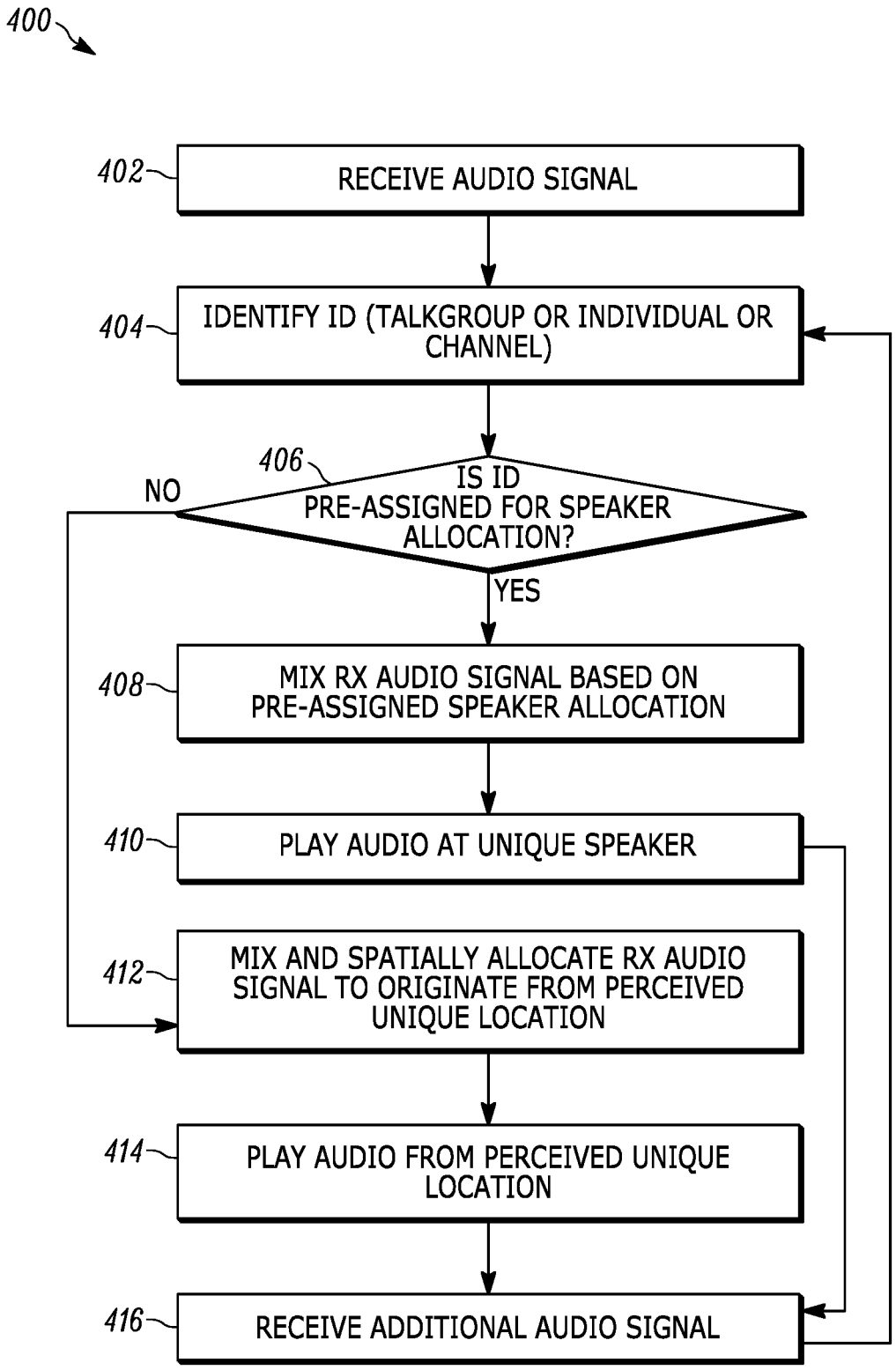
FIG. 4 is a method for managing incoming audio signals in a communication system in accordance with some embodiments.

FIG. 4 is a method 400 for managing incoming audio signals in a communication system in accordance with some embodiments. The communication system may be the communication system 100 of FIG. 1 or similar system having a plurality of speakers within proximity of a user. Method 400 covers several operating embodiments of the communication system. For example an audio signal may initially be received by two or more independent audio paths.

Method 400 begins at 402 by receiving an audio signal on two or more independent audio paths within an operating environment. For example, the audio signal may be received at the portable radio 102 and the mobile radio 110. Identifying an audio source ID for the received audio signal takes place at 404. In accordance with the embodiments, the audio source ID may be at least one of: talkgroup ID, an individual ID, and/or a channel ID. At 406, a check is made as to whether the audio source ID has been pre-assigned for a speaker allocation.

If the audio source ID has been pre-assigned for a unique speaker allocation at 406, then mixing of the audio signal from the two or more independent audio paths is performed (portable and mobile) at 408 to spatially resolve playing out the audio signal at 410 at the single unique speaker location based on the pre-assigned speaker location associated with the audio source ID. An additional audio signal, if any can be received at 416. Method 400 then returns to 404 to repeat the steps of identifying through playing as appropriate.

If the audio source ID has not been pre-assigned for a unique speaker allocation at 406, then mixing of the audio signal from the two or more independent audio paths (portable and mobile) is spatially resolved to originate at a single unique perceived location at 412. The single unique perceived location is between speakers. Audio is played out from the unique perceived location at 414. An additional audio signal, if any can be received at 416. Method 400 then returns to 404 to repeat the steps of identifying through playing as appropriate.

In accordance with a further embodiment, if an additional audio signal is received at 416 with no pre-assigned speaker associated with its identified individual ID, talkgroup ID or channel ID at 406, then the controller spatially allocates the additional audio signal to play out from a perceived unique location amongst the plurality of speakers within the communication system.

In accordance with a further embodiment, if two different audio signal are received within the communication system, for example in a situation where the communication system comprises portable radio 102, mobile radio 110, and portable radio 122 in FIG. 1, then method 400 applies and a controller, such as in the mobile radio 110, scans for an audio source ID, the audio source ID comprising one of: a talkgroup ID or an individual ID, for each different audio signal of the two different audio signals takes place. Verification for predetermined speaker assignment is performed as in 406, based on the identified talkgroup ID, individual ID, or channel ID for each of the two different received audio signals followed by assigning each different audio signal to its determined speaker assignment at 408. Each different audio signal is played out at each assigned speaker assignment at 410. In accordance with a further embodiment, if an additional audio signal is received without a predetermined speaker assignment, then the step spatially allocating the additional audio signal to play out from a perceived unique speaker location takes place at 408. The assignment of the two or more different audio signals to speaker location is adjustable based on a current incident within which the communication system is operating. The two different audio signals originate from a portable radio worn by a user and a mobile radio within a public safety vehicle, while a third additional signal originates from another portable, for example worn by another user within the vehicle 106 of FIG. 1. Thus, the method 400 provides for a plurality of received audio signals being received together with additional and different incoming signal(s) being added thereto.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method of managing audio signals within a communication system, comprising:

receiving an audio signal on two or more independent audio paths within a vehicle, the audio signal on the two or more independent audio paths originating from both a mobile radio seated within the vehicle, the mobile radio having a plurality of vehicular speakers mounted within the vehicle, and a portable radio seated within the vehicle, the portable radio having a speaker, the audio signal on the two or more independent paths being the same audio signal;

identifying, by a controller of at least one of the mobile radio and the portable radio, an audio source ID associated with the audio signal, wherein the audio source ID comprises at least one of:

a talkgroup ID;

an individual ID; and a channel ID associated with the audio signal; and mixing the audio signal from the two or more independent audio paths on two or more speakers so that the audio signal is spatially resolved to play out at a single unique perceived location within the vehicle based on the audio source ID, and the mixed audio signal being spatially separated from other audio signals being played out within the vehicle.

2. The method of claim 1, wherein mixing the audio signal from the two or more independent audio paths generates a grid of unique locations based on audio source ID.

3. The method of claim 1, further comprising:

receiving an additional different audio signal on the two or more independent audio paths for a different audio source;

repeating the steps of identifying through mixing for the different additional audio signal; and playing out the additional mixed audio signal at one or more speakers thereby generating another single audio signal at another unique perceived location based on the audio source.

4. The method of claim 1, wherein the two or more independent audio paths, comprise: a portable communication device having a speaker; and a mobile vehicular radio having plurality speakers.

5. The method of claim 1, wherein the two or more independent audio paths, comprise: an audio path associated with a first portable radio having a first speaker;

a second audio path associated with a second portable radio having a first speaker; and a mobile vehicular radio having a plurality speakers.

6. The method of claim 1, wherein the two or more independent audio paths, comprise: an audio path associated with a portable radio having a speaker; and one or more audio paths associated with a dispatch center having a plurality of speakers.

7. A communication system, comprising:

a mobile two-way radio having a plurality of speakers located within a vehicle;

a portable two-way radio having a speaker located within the vehicle;

a controller of the mobile two-way radio or the portable two-way radio for identifying a sound source ID for a received audio signal generated on independent audio paths of the mobile two-way radio and the portable two-way radio, the sound source ID comprising at least one of: a talkgroup ID, a individual ID, and a channel ID; and the received audio signal from the independent audio paths of the mobile two-way radio and the portable two-way radio being mixed to play out at a spatially separated unique location within the vehicle from other audio signals based on the sound source ID, each sound source ID having a unique location within the vehicle.

8. The communication system of claim 7, wherein each sound source ID is associated to a sound source location within a grid pattern.

9. The communication system of claim 8, wherein the controller identifies each sound source ID and maps each identified sound source ID to a location in the grid pattern associated with one of the plurality of speakers.

10. The communication system of claim 9, wherein the controller identifies each sound source ID and maps each identified sound source ID to a location in the grid pattern associated between two of the plurality of speakers.

11. The communication system of claim 10, wherein predetermined sound source IDs are have predetermined ranking with respect to each other which establish volume setting, muting, and location.

12. The communication system of claim 7, wherein a higher priority sound source ID is played out at a higher volume at a speaker location which is located closer to a user, while a lesser priority sound source ID is either muted or played out at a speaker location which is located farther from the user.

* * * * *